US012528612B2

(12) United States Patent
Salisbury et al.

(10) Patent No.: US 12,528,612 B2
(45) Date of Patent: Jan. 20, 2026

(54) DEVICE, SYSTEM, METHOD AND PRODUCT FOR STRETCH WRAPPING

(71) Applicant: AAA PACKAGING SUPPLIES PTY LTD, Keilor Park (AU)

(72) Inventors: Timothy Salisbury, Keilor Park (AU); Jonathan Salisbury, Keilor Park (AU)

(73) Assignee: AAA PACKAGING SUPPLIES PTY LTD, Keilor Park (AU)

( * ) Notice: Subject to any disclaimer, the term of this patent is extended or adjusted under 35 U.S.C. 154(b) by 0 days.

(21) Appl. No.: 18/547,034

(22) PCT Filed: Feb. 21, 2022

(86) PCT No.: PCT/AU2022/050121
§ 371 (c)(1),
(2) Date: Aug. 18, 2023

(87) PCT Pub. No.: WO2022/174302
PCT Pub. Date: Aug. 25, 2022

(65) Prior Publication Data

US 2024/0140634 A1 May 2, 2024

(30) Foreign Application Priority Data

Feb. 22, 2021 (AU) ..... 2021900460

(51) Int. Cl.
*B65B 11/04* (2006.01)
*B65B 11/00* (2006.01)
(Continued)

(52) U.S. Cl.
CPC ..... *B65B 11/045* (2013.01); *B65B 11/006* (2013.01); *B65B 41/12* (2013.01);
(Continued)

(58) Field of Classification Search
CPC ..... B65B 11/045; B65B 11/006; B65B 41/12; B65B 2011/002; B65B 2220/06;
(Continued)

(56) References Cited

U.S. PATENT DOCUMENTS 4,093,140 A * 6/1978 Matsunaga ..... B65H 35/02 242/529
4,155,238 A * 5/1979 Rogers ..... B65H 18/103 72/204
(Continued)

FOREIGN PATENT DOCUMENTS

FR 2668448 A1 4/1992

OTHER PUBLICATIONS

International Search Report and Written Opinion, PCT/AU2022/050121, dated May 24, 2022 (14 pp.).

*Primary Examiner* — Dariush Seif
(74) *Attorney, Agent, or Firm* — Eversheds Sutherland (US) LLP

(57) ABSTRACT

The present application relates to apparatus for stretch wrapping goods with stretch wrap film including: a film roll carriage for dispensing at least one band of film from at least one stretch wrap film roll core, a roping mechanism for roping the at least one band of film by edging at least one lateral side edge of the film, a pre-stretcher for pre-stretching the film by passing the roped film through a pre-stretcher, a stretch wrap carousel for wrapping the roped and pre-stretched film around the goods, wherein the at least one band of film is passed through the roping mechanism prior to the pre-stretcher.

7 Claims, 7 Drawing Sheets

(51) Int. Cl.
*B65B 41/12* (2006.01)
*B65H 18/10* (2006.01)

(52) U.S. Cl.
CPC ..... *B65H 18/103* (2013.01); *B65B 2011/002* (2013.01); *B65B 2220/06* (2013.01); *B65H 2301/5155* (2013.01); *B65H 2701/1944* (2013.01)

(58) Field of Classification Search
CPC ..... B65H 18/103; B65H 2301/5155; B65H 2701/1944
See application file for complete search history.

(56) References Cited

U.S. PATENT DOCUMENTS 4,173,313 A * 11/1979 Rogers ..... B65H 16/103 242/534
4,336,679 A * 6/1982 Lancaster ..... B65B 11/006 53/399
4,421,283 A * 12/1983 Rippin ..... B65H 35/02 242/529
4,563,863 A * 1/1986 Humphrey ..... B65B 11/045 53/556
4,671,043 A * 6/1987 Forni ..... B65B 53/00 53/399
4,754,594 A * 7/1988 Lancaster ..... B65B 11/045 53/399
4,807,427 A * 2/1989 Casteel ..... B65B 11/006 53/389.2
5,031,771 A * 7/1991 Lancaster ..... B65B 11/006 53/399
5,168,685 A * 12/1992 Suzuki ..... B65B 11/045 53/556
5,195,297 A * 3/1993 Lancaster ..... B65B 11/045 53/399
5,385,001 A * 1/1995 Ramer ..... A01F 15/071 53/399
5,447,009 A * 9/1995 Oleksy ..... B65B 11/045 53/399
5,463,843 A * 11/1995 Sharp ..... B65B 11/006 53/399
5,797,246 A * 8/1998 Martin-Cocher ..... B29C 55/06 53/399
5,819,503 A * 10/1998 Lancaster, III ..... B65B 11/585 53/399
6,796,105 B2 * 9/2004 Rossi ..... B65B 51/20 53/399
6,964,392 B1 * 11/2005 Matsunaga ..... B65H 23/188 242/530.1
6,971,220 B1 * 12/2005 Rampp ..... A01F 15/0715 53/449
7,475,844 B2 * 1/2009 Kuwabara ..... B65H 18/106 242/530.1
7,581,368 B1 * 9/2009 Bison ..... B65B 11/585 53/399
7,779,607 B2 * 8/2010 Lancaster, III ..... B65B 11/025 53/399
7,905,443 B2 * 3/2011 Papania ..... B65H 20/32 226/118.2
7,908,831 B1 * 3/2011 Dugan ..... B65B 11/006 53/389.2
8,549,819 B1 * 10/2013 Bison ..... B65B 11/585 53/399
8,707,664 B1 * 4/2014 Bison ..... B65B 11/045 53/449
9,802,722 B1 * 10/2017 Bison ..... B65B 11/585
9,908,648 B2 * 3/2018 Lancaster, III ..... B65B 11/045
9,932,137 B2 * 4/2018 Lancaster, III ..... B65B 11/025
10,538,350 B2 * 1/2020 Lancaster, III ..... B65B 57/04
11,434,029 B1 * 9/2022 Bison ..... B65B 59/003
11,628,959 B1 * 4/2023 Bison ..... B65B 41/16 53/399
11,685,562 B1 * 6/2023 Bison ..... B65B 11/006 53/399
11,939,089 B1 * 3/2024 Nicholson ..... B65B 11/006
2002/0020145 A1 * 2/2002 Matsumoto ..... B65B 11/585 53/399
2005/0044812 A1 * 3/2005 Lancaster, III ..... B65B 41/16 53/399
2008/0066431 A1 * 3/2008 Cousins ..... B65B 11/045 53/465
2008/0209859 A1 * 9/2008 Vanderheiden ..... B65B 11/025 53/399
2009/0188213 A1 * 7/2009 Lardinois ..... B65B 11/006 53/449
2009/0235617 A1 * 9/2009 Moore ..... B65B 11/045 53/461
2009/0293435 A1 * 12/2009 Johnson ..... B65B 45/00 53/461
2011/0088359 A1 * 4/2011 Brocard ..... B65B 11/585 53/461
2014/0109525 A1 * 4/2014 Nelson ..... B65B 11/045 53/462
2014/0331609 A1 * 11/2014 Bison ..... B65B 11/585 53/219
2015/0197355 A1 * 7/2015 Bison ..... B65B 11/045 53/414
2015/0203232 A1 * 7/2015 Nelson ..... B65H 23/06 242/422.4
2017/0305583 A1 * 10/2017 Nelson ..... B65B 67/085
2019/0084703 A1 * 3/2019 Nicholson ..... B65B 11/045
2021/0107757 A1 * 4/2021 Cere' ..... G01B 5/043
2021/0139175 A1 * 5/2021 Suolahti ..... B65B 11/025
2022/0119139 A1 * 4/2022 Vaccari ..... B65B 11/025
2022/0204197 A1 * 6/2022 Nelson ..... B65B 11/58
2022/0227513 A1 * 7/2022 Cere' ..... B65B 11/025
2022/0395995 A1 * 12/2022 Salisbury ..... B65B 61/06
2023/0049546 A1 * 2/2023 Cer ..... B65B 11/025
2024/0140634 A1 * 5/2024 Salisbury ..... B65H 18/103

* cited by examiner

DEVICE, SYSTEM, METHOD AND PRODUCT FOR STRETCH WRAPPING

RELATED APPLICATIONS

This application claims priority to Australian Provisional Patent Application No. 2021900460 in the name of AAA Packaging Supplies Pty Ltd, which was filed on 22 Feb. 2021, entitled "Device, System, Method and Product for Stretch Wrapping" and the specification thereof is incorporated herein by reference in its entirety and for all purposes.

FIELD OF INVENTION

The present invention relates to the field of wrapping items and loads, particularly stretch wrapping in which ventilation of the load is required or beneficial. In one aspect the present invention is suitable for use in stretch wrapping loads on pallets. In another aspect the present invention is suitable for producing ventilated film used for stretch wrapping. The present invention is useful by any industry that requires palletized loads to breath or ventilate while being stored or transported. It will be convenient to hereinafter describe the invention in relation to wrapping palleted loads however it should be appreciated that the present invention is not so limited and is suitable for use in the field of wrapping generally and for wrapping a wide range of goods, or collections of goods. It may also be used with a wide range of film, not solely materials used for wrapping.

BACKGROUND ART

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Unit loads of goods are often placed on pallets. Pallets generally have a flat structural foundation that is configured for ready handling, storage and movement by fork lifts, pallet jacks, front loaders, jacking devices or cranes. Wooden pallets for example, typically consist of multiple stringers that support deck boards on which the goods are stacked, where stringers are the boards that are sandwiched in a vertical or on their side disposition between the top and bottom deck boards. Typically, pallets are made of timber, metal, plastic and other materials. Pallets have supplanted older forms of transporting goods such as boxes and wooden barrels.

Often a unit load is secured to the pallet and protected by a film such as plastic pallet wrap film, i.e., stretch film, that is stretched around the goods and pallet, either by hand, or by a wrapping machine. Stretch wrap can also be used in horizontal spiral wrapping machines to protect a bundle of goods, such as lengths of timber, or flat pack cabinet panels.

Pallet wrapping machines typically comprise a rotary turntable on which a pallet stacked with goods is placed for rotation during the wrapping process. A roll of stretch wrap is located adjacent the turntable and the wrap is drawn from the roll and applied to the goods and pallet as the turntable rotates. The roll is moved up and down to apply overlapping layers of stretch wrap on the goods and the pallet. As an option with some machines, at the end of the wrapping process the film may be gripped by a pair of jaws and then cut. The cut end of the wrap is then usually pressed and adhered to the film covering the goods. The end of the wrap extending from the roll remains held by the gripping jaws until the wrapping process is recommenced on a new pallet. Generally speaking, there are three types of stretch wrapping machines. Firstly, there are "semi-automatic" machines, which require manual attachment of the film to the pallet load before wrapping the pallet. The stretch film tail that remains of the stretch wrap film on completing the pallet wrapping needs to be cut off once the pallet has been wrapped. This type of pallet wrapping machine may suit a majority of warehouse environments with a low to medium number of pallets to be wrapped per day. Typically, the machine can be pre-set with a number of user programs that cater to system parameters, such as for example, automatically adjusting the wrapping tension of the film at various times through the wrapping procedure. This programmed or automated operation takes place once the film is manually attached. More automated pallet wrapping machines are preferred where there are higher volume or throughput requirements. Secondly, there are "automatic" machines, where the automatic pallet wrapper may come with the same programming options as the semi-automatic machine and more. However, in contrast to the semi-automatic machine, the automatic machines may automatically attach the stretch film to the pallet and cut it off and seal it back at the end of each wrapping cycle without any manual intervention required. This may be controlled by a remote or a mounted control button nearby to the operator or forklift driver to obviate the need for manual intervention. However, the pallets still require being conveyed to and from the wrapping machine. Thirdly, there are "fully automatic" machines in which these machines may be used to integrate into automated conveyed packaging lines within a warehouse by way of the machines being made to suit production lines of individual specifications. This is almost operator less pallet wrapping with a commensurate reduction in labour costs.

Making sure boxes stay on the pallet and properly aligned is an important consideration in warehouse distribution and materials handling in general, especially as the demands for increased throughput of goods and materials continues to rise. Further, correct load containment is critical to eliminate pallet movement while in transport. In this respect, a large number of accidents in transport roll overs are due to load movement.

Pallet wrapping machines are well known in the art. A typical pallet wrapping machine is disclosed for example, in U.S. Pat. No. 9,981,762. (Chambers).

Pallet wrap is often referred to by names such as 'stretch film' or 'stretch wrap'. However, pallet wrap is distinguished from other types of polymer film by its characteristic resilience in use in so far as its ability to stretch and then pull back. Pallet wrap typically comprises stretch wrap or stretch film, which is a highly stretchable plastic film that is wrapped around items, i.e., goods and/or materials. The elastic recovery keeps the items tightly bound. In contrast, shrink wrap is applied loosely around an item and shrinks tightly with heat. Stretch wrap is frequently used to unitize pallet loads but also may be used for bundling smaller items. By way of example, types of stretch film may include bundling stretch film, hand stretch film, extended core stretch film, machine stretch film and static dissipative film. A common stretch wrap material is linear low-density polyethylene (LLDPE), which is produced by copolymerization of ethylene with alpha-olefins, the most common of which are butene, hexene and octene. The use of higher alpha-olefins (hexene or octene) gives rise to enhanced stretch film characteristics, particularly in respect of elongation at break and puncture resistance. Other types of polyethylene and PVC can also be used. Stretch wrap films can have up to about 400% stretch at break point but are usually only stretched to between about 100% to about 300% in use. In use, stretch films are stretched to a percentage which is a function of what the machine itself will allow. Once stretched, the elastic recovery of the stretch wrap is used to keep the load tight. There are generally two methods of producing stretch wrap, namely, as follows. 1) Blown: a polymer resin is melted and extruded through an annular die and then, it is air-cooled. This is a slower process but provides for higher quality product in function and application. The cost of production may also be higher due to the quantity that can be produced per hour. 2) Cast: the film is extruded through a slot die, then passed over cooling rollers. This makes the cooling process quick. The end product quality is not as good as blown but more can be produced in an hour with lower costs. In pallet unitizing, stretch wrap can have several functions, such as the following:

- improved stability of goods and materials in the form of products or packages, forming a unit load
- more efficient handling and storage of unit loads
- some degree of dust and moisture protection
- some degree of tamper resistance and resistance to package pilferage
- some degree of sun protection (UV resistant stretch wraps)
- extend shelf life of certain foods In general, the more the pallet wrap can stretch, the tighter the wrap may be. A pallet wrap that stretches well with high resilience that provides an ability for the wrap to lock in and pull back tight ensures the wrapped load is tightly secured to the pallet, reducing the chance of breakages and other damage to the goods.

One of the characteristics of pallet wrap as applied from a uniform roll of film wrap is that it may not 'breathe' sufficiently to keep the wrapped goods in peak condition. This is a consideration for pallet loads that include certain product types, for instance, cooled or refrigerated loads, perishable loads and medical loads by way of example. 'Breathing' refers to an exchange, across the stretch film material that bounds the goods, of gases such as oxygen, small molecules such as water, and also heat. While this is unlikely to be a problem for goods such as for example metal nails or plastic cups, it can be a problem for pharmaceutical compounds or fruit, vegetables, flowers, eggs and other foodstuffs, plants, or other perishable goods. These types of goods can be damaged during transport due to condensation forming between the load and the wrap, or lack of oxygen can cause wilting and discolouration. Furthermore, condensation can affect certain types of packaging by corroding metal caps, discolouring labels, causing mould growth and introducing moisture to products comprising paper or cardboard. In many cases, the goods end up with poor appearance or condition and may become unfit for consumption.

This problem is generally addressed by applying pre-slit or 'ventilated' film as a stretch wrap to be used in a normal stretch wrapping machine for the palletised goods. The slitting permits air flow to help prevent condensation from building up under the film so that the goods can remain fresh and condensation free. Whilst ventilated film is available presently in the market, the manufacturing of it off site makes it so expensive it is often not commercially viable to use. Ventilated film is supplied as a full width roll of stretch wrap film provided with holes or slits which provide the ventilation as and when the film is applied to the palletized goods.

Another significant problem is that stretch films are predominately used to provide load containment stability to a load being stored or transported. Quality Load containment force is critical to avoid movement and spillage of loads in storage and transportation. Pre slit or 'ventilated' film as a stretch wrap is restricted in its load containment ability by at least the following three factors:

1. An inability to stretch sufficiently to avoid distorting the pre-cut holes, slits or perforations that ordinarily provide for ventilation with the film;
2. Due to factor 1, above, the final wrap may not be sufficiently tight and that leads to a requirement for additional layers of wrapping to be applied. However, these additional layers may cover over any ventilation given by the earlier layers of film, in effect leaving the goods wrapped with little, if any at all, actual true or useful ventilation;
3. Each load type varies considerably in its weight and therefore load containment needs. Pre slit or 'ventilated'; films cannot allow for these variations because these pre-fabricated stretch films do not provide for suitable variation to (a) width of films, (b) ventilated holes, (c) reinforced edges and, (d) roping strengths that would otherwise allow for the correct amount of film to be used for each unique load containment application.

Current examples of pre-slit or 'ventilated' film are expensive and this tends to make their widespread or common use prohibitive or at best commercially restrictive. In turn, this increases the likelihood that users will not use such wrapping as they should or could in situations that warrant it to adequately wrap and protect product/produce being supplied to the consumer. Also, standard ventilated stretch film is expensive to manufacture and is limited to the way it can be applied. Current vented films are limited to a feasible reduction in plastic material to be presented on application to the pallet and that which is possible due to the width of film for application being a standard film width, for example, 500 mm, together with the fact that a preponderance of machines support only this type of specification of film. Furthermore, with these constraints conventional pre-ventilated (or pre-slit) films that are typically made from material that is about 20 μm or thicker are not generally able to be stretched beyond 200%. This limitation is required because of the inherent fragility of the pre-slit film that is brought about by the perforations in the film being weak spots. To address this, reinforcement bands may be added into the film, between the slits which in itself limits the possibility of stretching. As a result, if commonly used pre-slit film is stretched beyond 200%, it will most likely break or tear at or around the perforations of holes in the material. Such breakage will cause a failure of the wrapping process. It is also noted that sufficient stretching of pre-slit film to provide adequate load containment force may also restrict the perforations by distortions that have the effect of closing over the perforations or holes which in turn limits air flow and makes the ventilation non operative.

In another prior art example, Phoenix Wrappers ULC provide a Breathe Easy™ film slitter which slices the pallet wrap into three (3) or more bands or strips of set width.

However, the prior art does not allow for adjustment or change of the strip width in a straightforward manner. In this respect, another example of prior art is disclosed by Canadian patent application No. 3,017,514 in the name of Phoenix Wrappers ULC (CA 3,017,514), which describes a method for securing a palletised load with stretch film wrap. In particular, the stretch wrapper disclosed is directed at overlapping two or more stretch films to obtain a multi-ply band where the overall resistance of the combined stretch film can be increased in the region of the multi-ply band to prevent any tear which might start in one of the initial stretch films from propagating along the entire width of the stretch film as it is applied to a pallet load. Essentially this prior art disclosure is directed at a stronger stretch wrap being produced by overlapping two or more films. Notably though, at pages 27 to 31 of the specification of CA 3,017,514 in conjunction with FIGS. 7, 11 and 15, there is disclosure according to some implementations of the invention for the width of an edged stretch film or of a rope being varied for a single palletised load and this is performed by the positioning of the guide(s) or roller(s) involved in the edging or roping of the stretch film around the palletised load being varied during a single stretch wrapping operation. However, in order to do so, the guide(s) or roller(s) are translated along a vertical axis using an automated system translating the guide(s) or roller(s) according to a given pattern. The vertical axis movement is required in order to effect a change of the overlap of the two or more stretch films that combine to form the multi-ply bands.

On inspection of the disclosures of the above noted prior art, it is evident that a great deal of complexity and commensurate expense is involved in providing breathable stretch wrapped pallets of goods/materials with these systems.

The prior art does not readily allow for modification or adaptation of existing wrapping machines to produce strip wrapping from non-ventilated stretch wrap in situ or strip (ventilated) wrapping of different widths in situ. In addition, the prior art does not provide for strips of stretch wrapping of differing width to be applied in situ in a manner that complies with the highest standards of occupational health and safety. It is also noted that, in prior art systems, the slicing of film may be performed by knife blades that are otherwise exposed or protruding, which can be considered a risk to the health and safety of operating staff.

Furthermore, at the completion of stretch wrapping a load of goods/materials, the stretch film is usually cut but there can be a tendency for the cut film to leave behind some excess unwanted material in the form of a "tail". The tails left behind in a stretch wrapping procedure may often be secured by use of a brush to swipe the excess film to the load. However, the tail may come loose, particularly if the load is handled frequently, subjected to a variety of conditions, or if it has been wrapped with film that low cling ability. A loose film tail can lead to unravelling of the film entirely and degrading the integrity of the load. In addition, the existence of tails upon stretch wrapping produce excess waste and costs associated with having to re-wrap a pallet. Further, if stretch wrap tail drags or protrudes from a pallet load, it could catch on objects and dismantle the load, in turn, being the cause of serious risk within the working environment.

In the alternative for providing ventilated wrapped pallet loads, attempts at mechanical slitters in situ with stretch wrapping machines have been provided in which the film is slit on or at the wrapping machine. However, whilst a mechanical slitter may be of use in a semi-automatic stretch wrapping machine, it is not considered viable to have a mechanical slitter operating reliably on an automatic or fully automatic wrapping machine because there is difficulty with installing a mechanical slitter low enough on these machines to have film tails eliminated.

It is considered that there is a need in the materials handling market, in particular for perishable goods and other goods requiring ventilated packaging for improved packaging systems to cater to fast turnover or high throughput with market supply chains.

The preceding discussion of background art is intended to facilitate an understanding of the present invention only. The discussion is not an acknowledgement or admission that any of the material referred to is or was part of the common general knowledge as at the priority date of the application.

SUMMARY OF INVENTION

An object of the present invention is to provide improved packaging that can be adapted according to the nature of the goods. A further object of the present invention is to provide an improved film, device and method for packaging material. Yet another object of the present invention is to provide a useful option for modifying existing packaging machines and processes to provide packaging that breathes.

It is furthermore an object of the embodiments described herein to overcome or alleviate at least one of the above noted drawbacks of related or prior art systems or to at least provide a useful alternative to related or prior art systems.

In one aspect, a preferred embodiment of the present invention provides a stretch wrap film product comprising:

- a single film roll core accommodating stretch wrap film in the form of a plurality of individual bands of film.

Preferably, the single core accommodates stretch wrap film in the form of at least three bands of film. In preferred embodiments the plurality of individual bands of film accommodated on the single film roll core are formed by pre-cutting a unitary width of stretch wrap film disposed on the single film roll core.

In accordance with preferred embodiments, the stretch wrap film product is adapted for use as ventilated film wrapping. The stretch wrap film product may be adapted for use as ventilated film wrapping by roping the individual bands of film for pre-stretching and wrapping the individual bands around a unit load of goods. Furthermore, the stretch wrap film product may be adapted for use as ventilated film wrapping by dispensing the individual bands of film in parallel from the single film roll core for roping, pre-stretching and wrapping the individual bands around a unit load of goods.

In another aspect, a preferred embodiment of the invention provides a method of fabricating a stretch wrap film product, the method comprising the steps of:

- forming a single film roll comprising a unitary band of stretch wrap film;
- unwinding the single film roll under tension;
- cutting the unitary band of stretch wrap film into a plurality of individual bands of film;
- rewinding the plurality of individual bands of film to a single film roll core to provide a multi-band roll of stretch wrap film.

In a preferred embodiment the step of rewinding produces a multi-band roll of stretch wrap film having at least three bands of film.

In a further aspect, a preferred embodiment of the invention provides a method of stretch wrapping goods with stretch wrap film, the method comprising the steps of:

dispensing at least one band of film from a single stretch wrap film core;

roping the at least one band of film by edging at least one lateral side edge of the film;

pre-stretching the film by passing the roped film through a pre-stretcher;

wrapping the roped pre-stretched film around the goods, wherein the method is characterized in that the step of roping is performed prior to the step of pre-stretching.

Preferably, the combination of the steps of roping and pre-stretching the roped film binds the stretch film material into a higher yield strength material than the at least one band of film dispensed from the single stretch film core.

In preferred embodiments, a plurality of bands of film are dispensed from the single stretch film core.

In yet another aspect of embodiments described herein, there is provided apparatus for applying stretch wrap film to unitize a pallet load of goods, the apparatus comprising:

a film roll carriage adapted to accommodate at least one stretch wrap film roll and dispense at least one individual band of stretch wrap film from the at least one stretch wrap film roll;

a roping mechanism comprising roping fingers to rope the at least one individual band of film; and a pre-stretcher for pre-stretching the at least one individual band of film.

Preferably, the film roll carriage accommodates a single film roll. Furthermore, the film roll carriage may dispense a plurality of individual bands of stretch wrap film from the at least one film roll. Moreover, in a preferred embodiment, the film roll carriage dispenses at least three individual bands of stretch wrap film from the at least one film roll.

In yet another aspect of embodiments described herein there is provided apparatus for stretch wrapping goods with stretch wrap film comprising:

a film roll carriage for dispensing at least one band of film from at least one stretch wrap film roll core;

a roping mechanism for roping the at least one band of film by edging at least one lateral side edge of the film;

a pre-stretcher for pre-stretching the film by passing the roped film through a pre-stretcher;

a stretch wrap carousel for wrapping the roped and pre-stretched film around the goods, wherein the at least one band of film is passed through the roping mechanism prior to the pre-stretcher.

Again, it is preferred that the film roll carriage accommodates a single stretch wrap film roll core and the film roll carriage dispenses a plurality of individual bands of stretch wrap film from the at least one stretch wrap film roll core.

In another embodiment, the apparatus further comprises one or a combination of:

compressed air means for applying compressed air to guide an end of the at least band of film into the wrapped goods;

welding means for welding at least one end of the at least one band of film to the wrapped film at the end of a wrapping cycle.

In essence, embodiments of the present invention stem from the realisation that in allowing for the roping and/or edging of stretch film prior to pre-stretching the film for application to a pallet load, the stretch film material is effectively strengthened by the binding of the film that takes place when roping and pre-stretching are processed in this order to allow increased stretching of the film upon its application to the pallet load without breakage. Furthermore, it was realised that the perforations of pre-slit 'ventilated' film are in fact weak points that cause film breakage in the wrapping process and so, in contrast to conventional pre-slit or ventilated film, by providing stretch film in multiple or parallel bands for the roping and pre-stretching operations this obviated the need for perforations or holes removing these weak points and allowing for tighter roping leading to increased yield strength of the stretched wrapping film so supplied to the palletised goods for ventilated packaging.

Other aspects and preferred forms are disclosed in the specification and/or defined in the appended claims, forming a part of the description of the invention.

Advantages provided by the present invention comprise the following:

The absence of holes normally associated with conventional pre-slit or ventilated film allows stretch film of embodiments of the invention to undergo greater stretching without breakage and the resultant wastage of material;

There is substantial cost reduction in having goods supported by a reliable load containment force that needs to either breath or ventilate;

Stretch film edges may be easily rolled which adds strength to each rope of film as applied eliminating breakages, down time and adding load containment force to the goods/material load;

Reliable roping is provided that enhances the likelihood of the bottom of a pallet to be wrapped without tails;

Provides high ventilation but strong stabilisation of a load of goods;

Ability to provide film material strips of predetermined width, or to vary the width during packaging;

A device of embodiments of the present invention can be modular;

A device of embodiments of the present invention can be retrofitted to some existing packaging machines;

A device of embodiments of the present invention substantially reduces the cost and complexity of existing pre-slit or ventilated film;

A product of embodiments of the present invention provides a useful and improved alternative to existing pre-slit or ventilated stretch film, which provides a cost-effectiveness in an economical option to be used for cold room storage so that energy costs in temperature control can be reduced reducing the need of high energy input to maintain integrity of shipped goods;

A product of embodiments of the present invention allows for a multitude of different wrapping patterns to ensure minimal film is applied;

The preferred ventilated film product is significantly less expensive to manufacture and in combination with the improved stretch wrapping process significantly less plastic material is used to wrap a pallet which reduces the costs per pallet wrapped;

Embodiments of the present invention allow for altering widths of pre-slitted film via the preferred roping system;

Embodiments of the invention provide for users to create unique stretch wrapping programs which can ensure the required amount of package ventilation is achieved to levels as required.

Embodiments of the present invention contribute to ensuring that during the transport of goods and materials the stretch film will not detach from the pallet which could cause the load to destabilise or not be accepted at distribution centres due to the OH&S requirements that all pallets have no tails before being accepted.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present invention may be better understood by those skilled in the relevant art by reference to the following description of embodiments taken in conjunction with the accompanying drawings, which are given by way of illustration only, and are not limitative of the disclosure herein, and in which.

DETAILED DESCRIPTION

List of Parts Shown in the Figures

| | | | |
|---|---|---|---|
| 1 | Stretch film roll core | 2 | Individual Bands of stretch film |
| 3 | Roping mechanism/fingers | 4a | Dispensed Individual bands of film |
| 4b | Roped individual bands | | |
| 6 | Roping mechanism guide roller | 7 | Film tail |
| 8 | Support bracket (for fingers) | 9 | Blower |
| 11 | Sealing Unit | 12 | Pre-stretch carriage |
| 13 | Unwind Roller | 14 | Tension Roller |
| 16 | Position Roller | 17 | Knife Roller |
| 18 | Groove Roller | 19 | 1st Rewind Roller |
| 21 | 2nd Rewind Roller | 22 | Banana Roller |
| 23 | Drive Roller | 24 | Jumbo roll |
| 26 | | 27 | |
| 28 | | 29 | |
| 100 | Turntable/carousel stretch wrapping machine | 200 | Film Roll Slitting system |

Multi-Band Core of Film

Conventional ventilated films generally do not stretch beyond about 200% without breakage and are made from typically thicker material upwards from about 20 μm. This is required due to the fragility of these films that is caused by the pre-cut holes to allow for ventilation, which it is realised diminish the structural integrity of the band of material. As such, if these ventilated i.e., perforated films are stretched beyond about 200% or have a lesser thickness, then upon stretching the film tends to break or tear around the pre-cut ventilation holes and leads to a failure in the wrapping process. Preferred embodiments of the improved stretch wrap film product disclosed herein will stretch to at least about 290% when manufactured with thicknesses of about 15 μm for the film material. Embodiments of the film product of the present invention that are essentially in the form of a single film roll core accommodating stretch wrap film in the form of a plurality of individual bands of film may utilise stretch wrap film of known thicknesses and material composition. Advantageously, the plurality of individual bands of film accommodated on the single film roll core are formed by pre-cutting a unitary width of stretch wrap film disposed on the single film roll core. Produced in this form, the film product is adapted for use as ventilated film wrapping with improved resilience for stretching, which is possible due to the absence of pre-cut holes that otherwise weaken the film. Furthermore, as described herein, the roping of the top/bottom edges of each of the film strands or bands contributes to improved stretch wrapping techniques and force to load strength giving reliable and measured load containment force.

Figure 3:
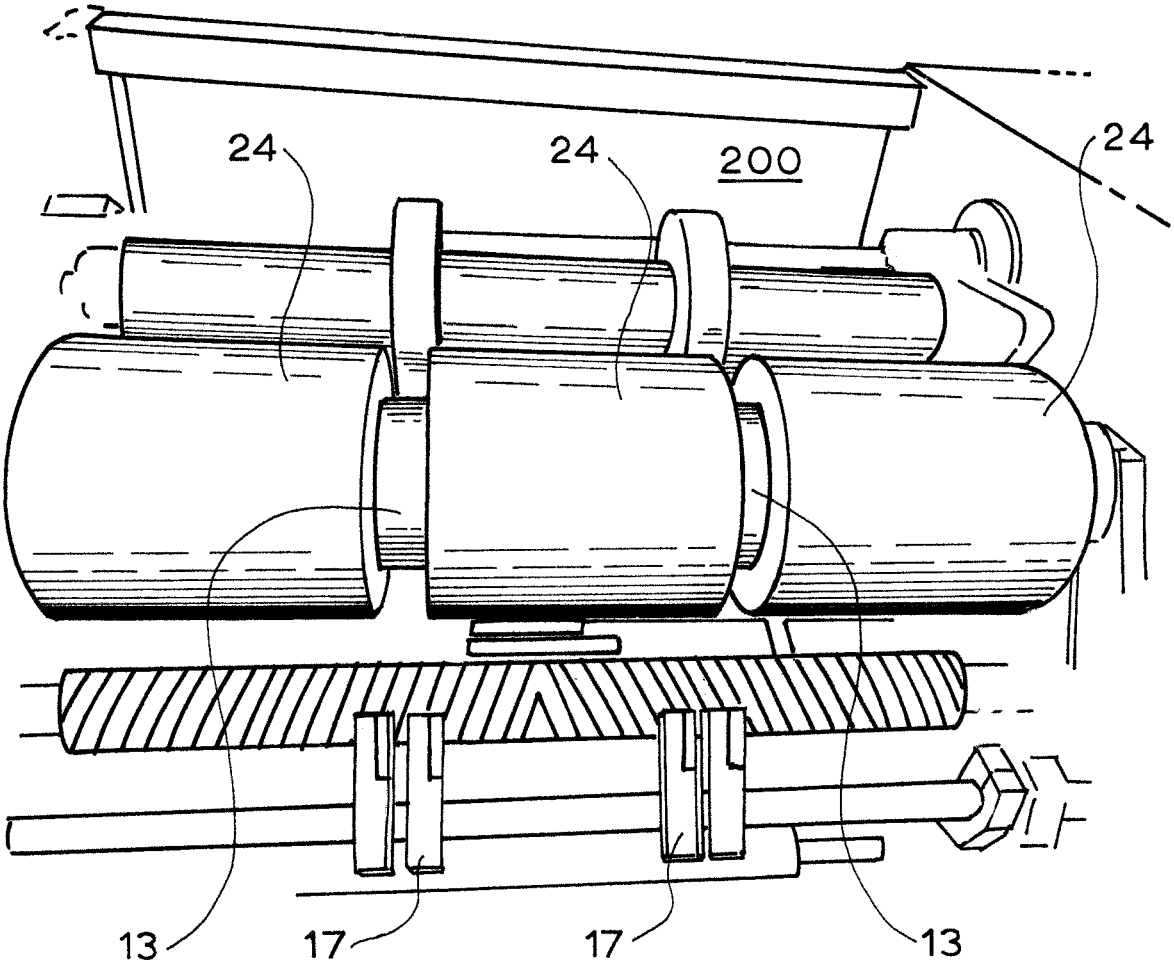
FIG. 3 is an internal view of a slitter rewinder machine (200) employing apparatus in accordance with another embodiment of the present invention.
Figure 7:
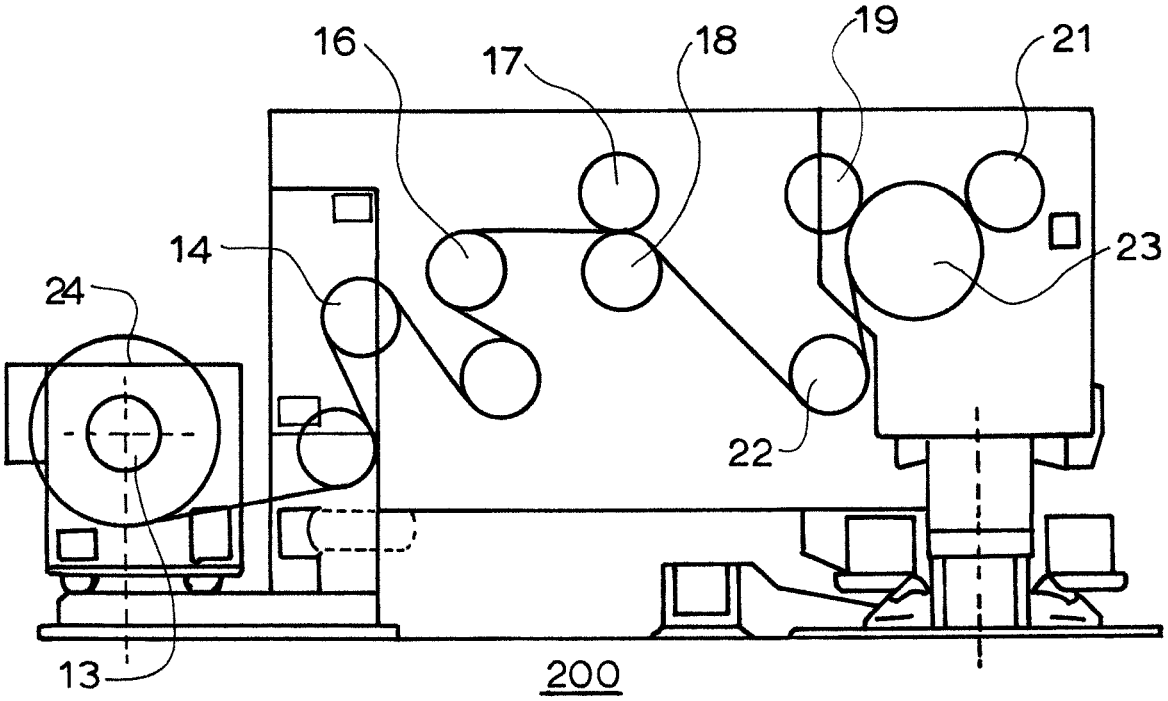
FIG. 7 is a plan view of the slitter rewinder machine of FIG. 3 illustrating its use in accordance with an embodiment of the invention.

With reference to FIGS. 3 and 7, in a preferred embodiment, a ventilated stretch film product is manufactured using a slitter rewinder machine 200. The film mother roll in the form of a jumbo roll 24 is feed into the slitter rewinder 200 to split the film into multiple bands, shown generally by knife holder 17, and the film passed through a banana roller 22 to create the gap between the film before being rewound back onto paper core at unwind roller 13. The trim being removed is rewound onto a separate core to save material.

In the production process schematically illustrated in FIG. 7 the manufacture of the multi-band film of embodiments begins with a Jumbo roll, preferably 515 mm, of machine grade material. Film is wound into the slitter rewinder 200. The film is first slit into 3×150 mm rolls. Then the slitted film is passed through a banana roller 22 to increase the film gap between each roll of the multiple roll formations. In a preferred embodiment of the multi-roll having three rolls formed, the film has to pass to a set tension controller to balance the winding tension between right/left roll to the middle roll. The film is then wound back into the paper core.

It should also be noted that conventional ventilated type films cannot be stretched as much as the film product of embodiments herein because by stretching such conventional ventilated or pre-slit films to the extent that is possible with the preferred product of embodiments will reduce the area of openings provided by the pre-cut holes to the point that effectively the number of active air/ventilation holes are reduced limiting air flow. The stretch film product of preferred embodiments is slit in width only and has no holes as such in it, which then allows film to be fully stretched. This has benefits in that the quantity of film used on a given wrapping will be limited and hence items may be wrapped while conserving waste film material.

In trials with a roping adaptor for wrapping machines testing was done on full width, 500 mm wide, where the stretch film was roped to a width of approx. 200 mm. This film product performed well in the pallet wrapping process providing good load stability but was inefficient due the amount of film wrap consumed in this particular format.

Modifications were then made to the film dispenser of a wrapping machine to fit two (2) 250 mm rolls of stretch film with the roping device of preferred embodiments described herein and the proved load containment remained high but also created the efficiency that larger users require, for example, in use of automatic and fully automatic stretch wrapping machines. The preferred type of film roll was produced in a 3-roll format which confirmed higher efficiency with equal load containment.

In a preferred process used to produce the multi slit roll of film is to first of all produce a large or "jumbo" roll of the stretch film by way of cast extrusion and then re roll the jumbo roll into standard length and width rolls. As would be appreciated by the person skilled in the art, these standard length and width rolls may be predominately about 500 mm×length to make up about 12 to 15 kg. As would also be appreciated by the person skilled in the art, this is similar to a conventional process for standard stretch film manufacturing. However, through this normal process the rolls are then converted by slitting the film and the non-used portions of film is remanded back onto other cores and then used again to recycling off-cut product.

Roping

Figure 1:
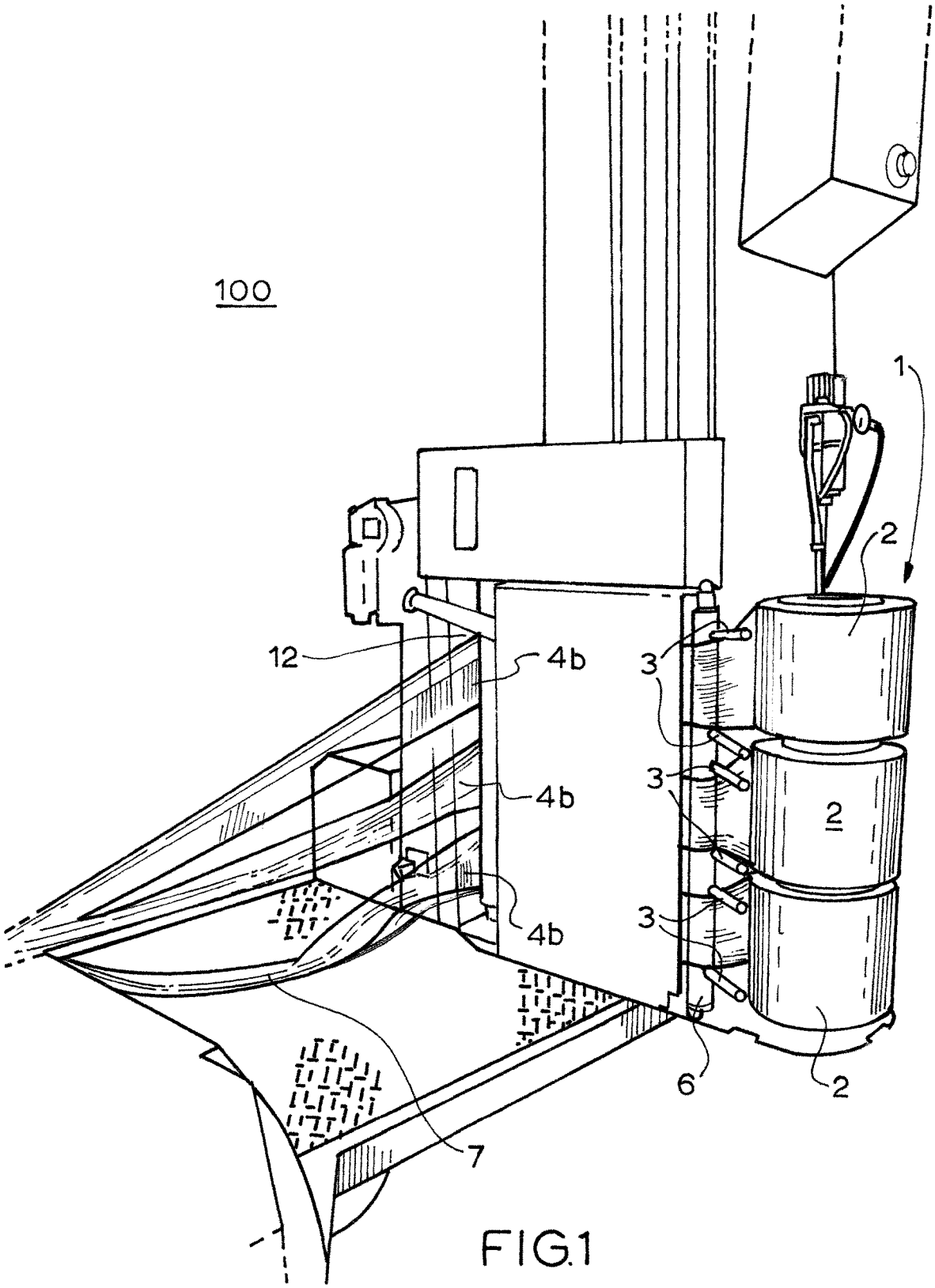
FIG. 1 illustrates a turntable or carousel stretch wrapping machine (100) employing apparatus in accordance with a preferred embodiment of the present invention.
Figure 2:
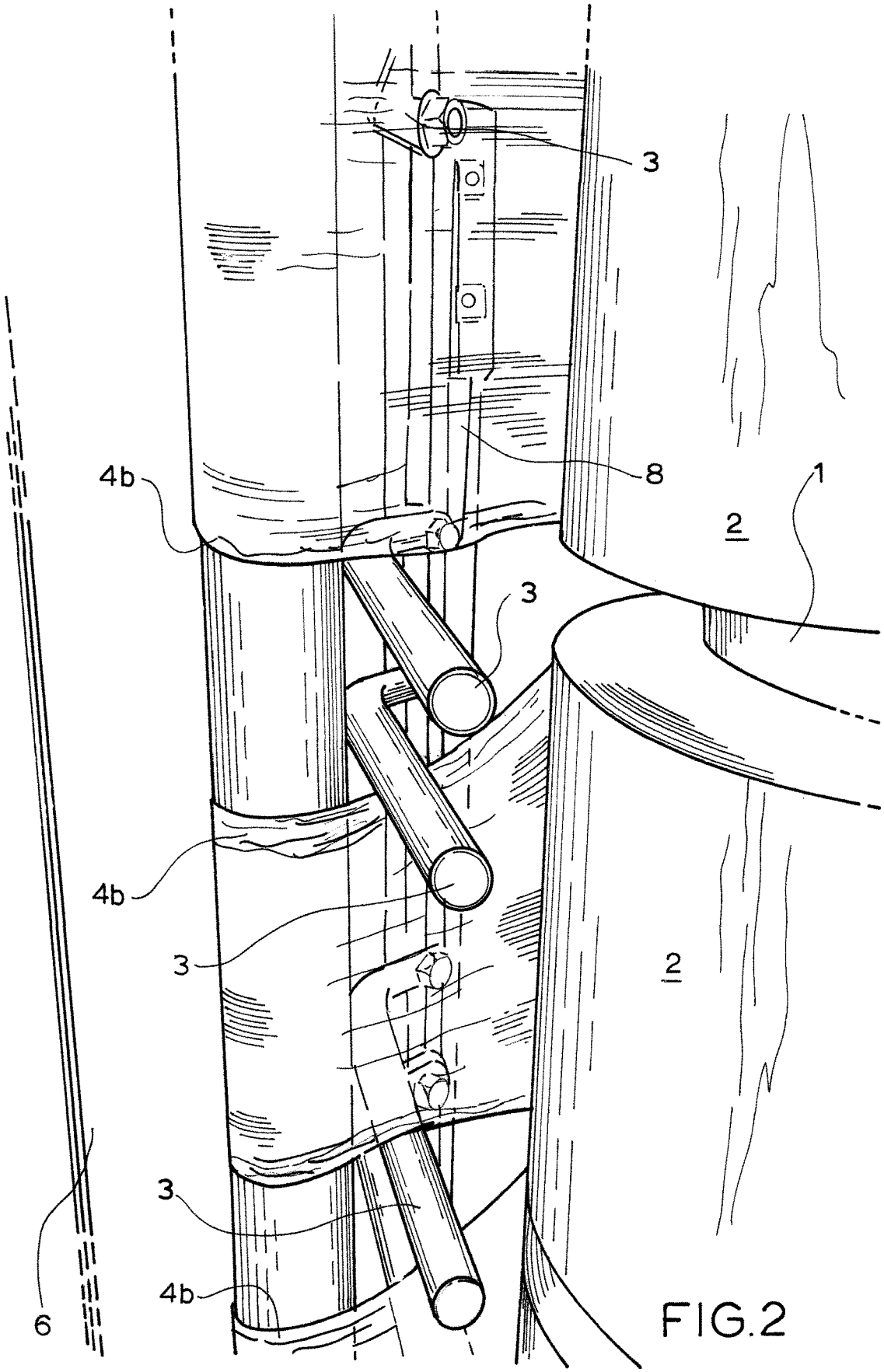
FIG. 2 illustrates a roping mechanism (6) in accordance with an embodiment of the present invention together with a stretch wrap film product of a preferred embodiment of the present invention.
Figure 4:
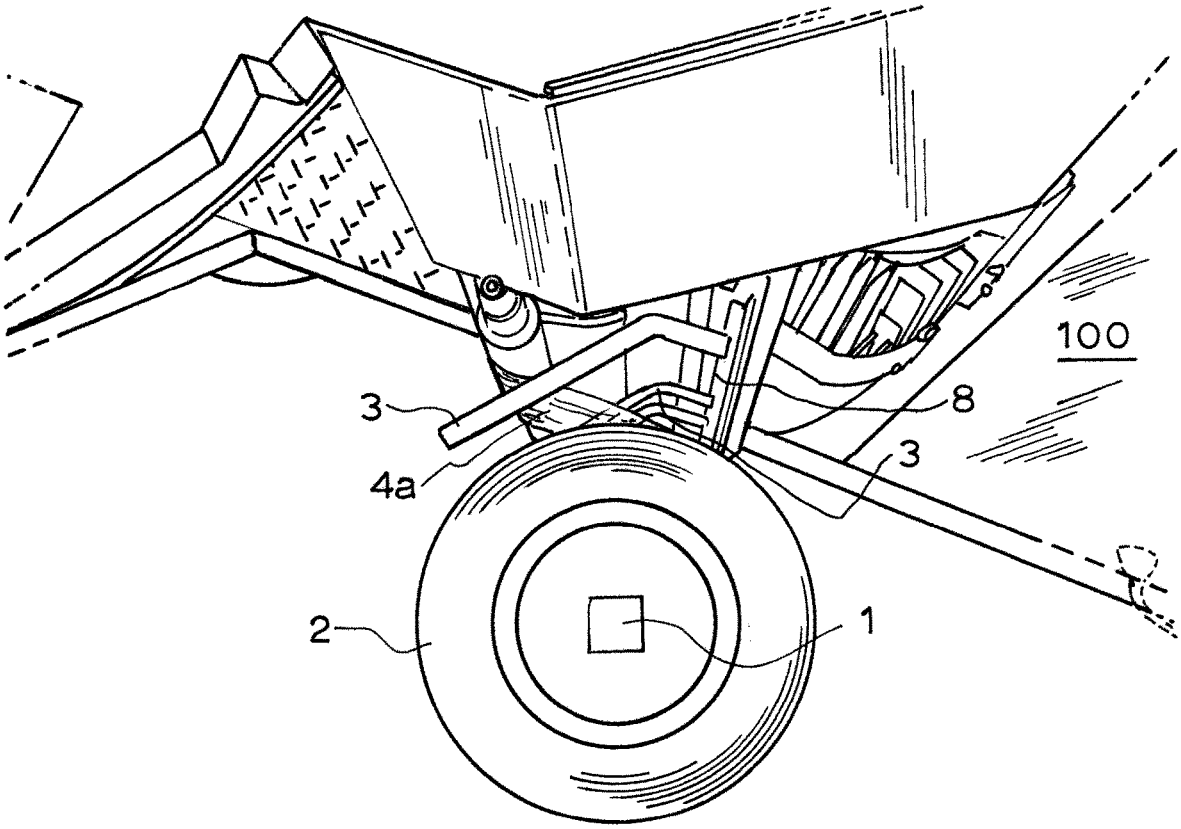
FIG. 4 illustrates the device and apparatus of FIG. 1 from a top perspective view.
Figure 5:
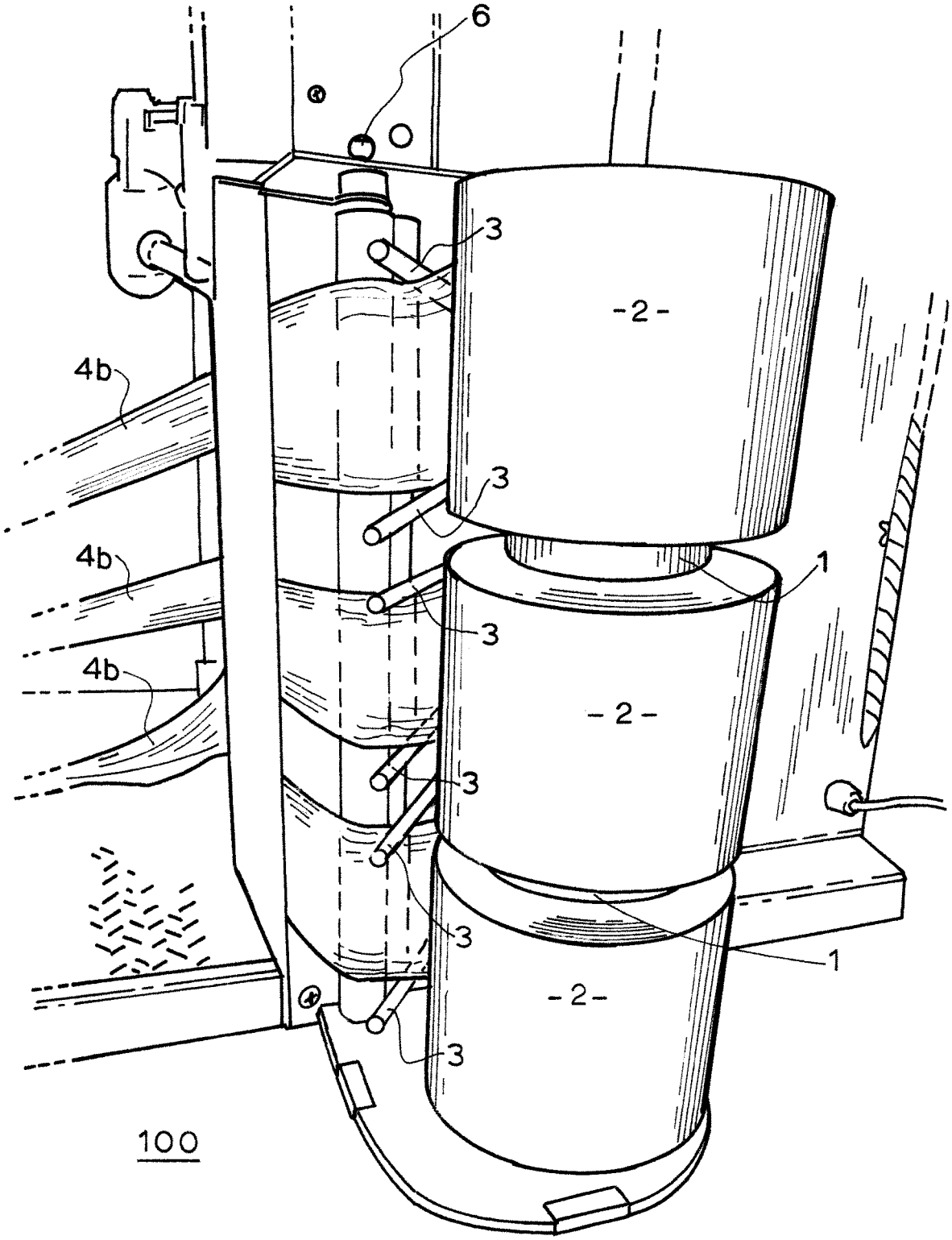
FIG. 5 is a side view of the device and apparatus of FIG. 1.

In preferred forms of a stretch wrapping system of the invention, a roping system is employed and which is made up of, preferably, six (6) film adjustment finger widths, which are illustrated in the preferred form shown in FIGS. 1, 2 and 4 but perhaps best shown in FIG. 5. Finger widths can be altered, modified or varied by loosening a fixing bolt and sliding the finger(s) along a support bracket 8 to increase or decrease the desired width of film band(s). The support bracket 8 is best shown in FIGS. 2 and 4.

The roper fingers 6 push the feed material inwards to bunch layers of the film to approx. 2-3 mm wide top and bottom. These bunched layers go through a series of rollers that bind them together and stretch the film in the range of about 250% to about 300% to form a roping & banding effect.

Stretch Wrapper Programmable Operation

In typical operation with embodiments, at the end of a wrapping cycle the wrapping machine pushes the three bands down to the bottom of the pallet into a width of approx. 100 mm wide. It will then pneumatically push out a sealing bar where the film will go across in the 100 mm form. This bar protects anything on the pallet from the heat/weld mechanism. The machine will continue to turn and apply an additional layer of 100 mm film that will go over the first layer. A second sealer bar, which may be heated to about 170-190° C., will then clamp the two pieces together and weld the film to itself. Part of the sealer with the heating mechanism has a cutter to separate it from the feed in film where it is clamped and ready for the next pallet.

In preferred embodiments utilising stretch wrapping apparatus of the present invention, unique customised operational programs may be created to ensure the required of amount of ventilation is provided to the stretch wrapped products to levels required. Essentially, there are 3 factors that contribute to creating these unique customised programs, as follows:

Film width adjustment via roping system

Turntable speed of machine

Stretch film carriage speed

Adjusting the film width to ensure product is captured or effectively wrapped is the first part in setting up the wrapping system. A desired reduction or increase to the film width may be dependent on whether goods such as cartons stacked on a pallet are small or large, hence the roping fingers 3 are adjusted to a width where coverage is obtained with allowances for gaps to let air to flow. The amount of gap between the film is also altered by adjusting the turntable speed of the carousel in conjunction with the film stretch carriage speed. By slowing the turntable speed and increasing the carriage speed film will be applied to the pallet to cause an increase in the gap between the film ropes 4*b* and allows more air to flow. Increasing the turntable speed and slowing the carriage speed reduces the gap between the film ropes 4*b* allowing less air but increased coverage around the products. Carriage speed may be adjusted in increments of about 1% and turntable speed by increments of about 1 rpm to a maximum of about 12 rpm, noting up to 20 rpm may be outside tolerances for most stretch wrapping machines. There may be many different variants to what users' requirements are for air flow based on size of pack, weight of load and need for rapid chill or ventilation and the preferred system can provide for these requirements. As such, with the programmed operation by adjusting the film width, carriage and turntable speed along with various tension settings a unique program is created to ensure coverage over all product but allowing the correct amount of gap to allow for proper ventilation for the product type.

The preferred film is a roll of three (3) bandings or widths of film 4*a* on the one core 1 which feeds through a stretch wrapping machine 100. Whilst feeding through it travels past a roping mechanism 6 which rolls the edges adding strength to the bands 4*a*, effectively turning the widths into roped sections of film 4*b*. Roping mounting or support bracket 8 allows for the roping fingers 3 to slide up/down to adjust width of the film bands 4*b* which are then pushed through the pre-stretch carriage 12 (indicated in FIG. 1) that binds and stretches the film to form a roped edge at the top and bottom of the film width. These roped widths 4*b* are applied to the pallet and stretched to provide the right measured load containment force.

The multiple widths (three widths in preferred forms) of roped film bands 4*b* solve the issues described above in relation to the current alternative full width ventilated film with holes/perforations in as it is instead banded to three narrowed widths allowing for increased control of load containment whilst reducing the consumers cost by over 40% on film material consumption. The bands that are roped provide a greater force to load characteristic than standard stretch film. Because they are roped the plastic is effectively binded to significantly increased in material density in areas that would normally break. Top and bottom tension can be adjusted to a much higher setting resolution thus allowing for increased load containment.

In addressing presently identified difficulties that warrant reduction of stretch film usage & costs, this system allows pallets to be wrapped with approximately 50% less film material and a cost reduction between about 20%-40%. With the combination of the steps of roping and then pre-stretching the roped film 4*b* this effectively binds the stretch film material into a higher yield strength material than one band of film 4*a* dispensed from a single stretch film core. Accordingly, less plastic is used because the film thickness can be reduced significantly by virtue of creating the higher yield ropes. Whilst conventional ventilated films are punctured to form holes this system provides a width of film with no film between the wrapping layers to provide the ventilation.

To address the need for sufficient air ventilation for palletised goods so as to allow products to breath such as fresh produce or rapid chill frozen goods, this system allows for the pallets to be wrapped with the right amount of gap to allow air flow whilst ensuring best load containment. This benefit is obtained by a combination of the roped film widths applied to a pre-stretching at wrapping together with the unique program of turntable and carriage adjustments as noted above.

Figure 6:
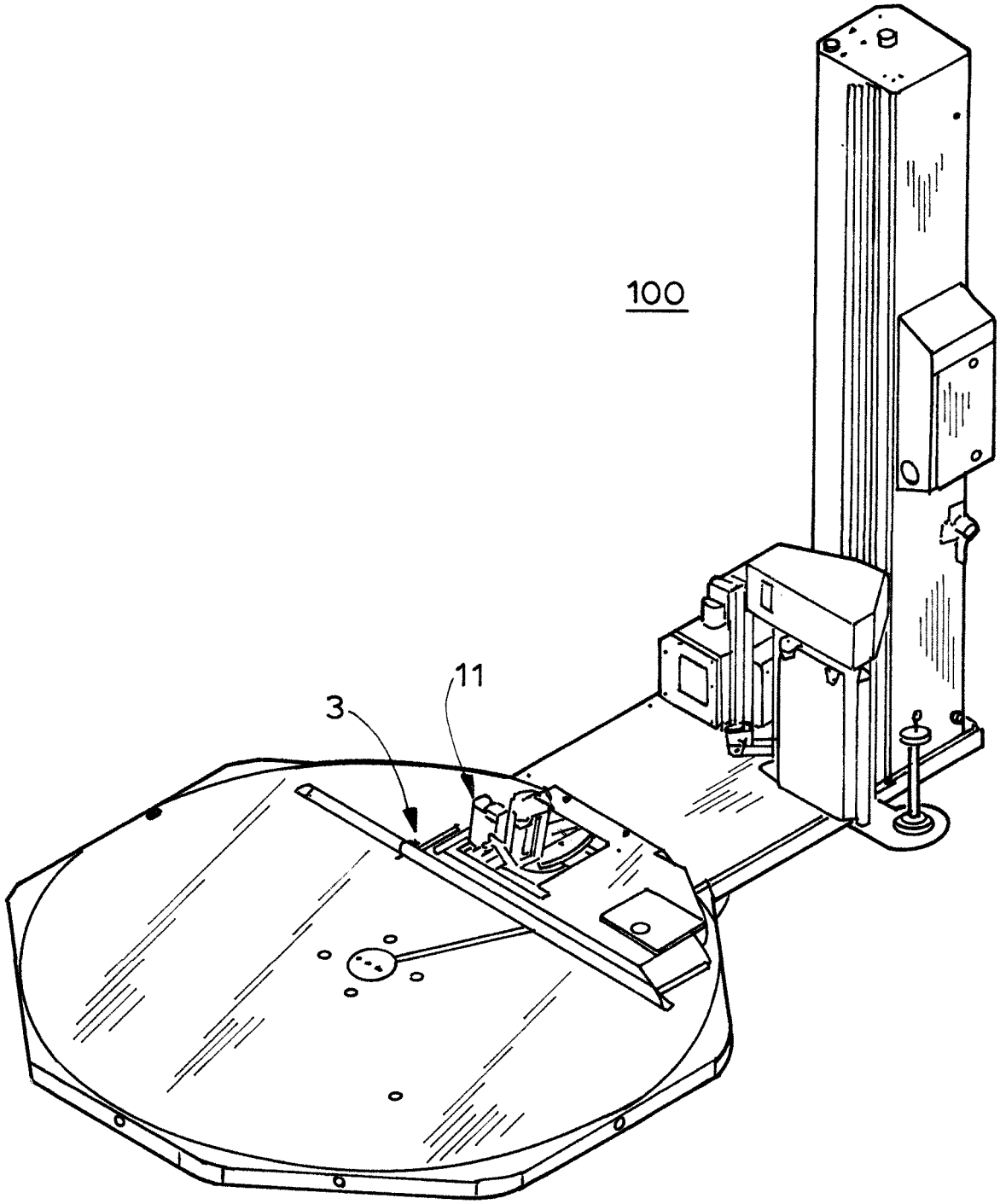
FIG. 6 shows an example a stretch wrapping carousel machine that utilises preferred features of the present invention.

An additional advantage provided in embodiments of the present invention is to avoid the phenomenon of tailing of wrap film in stretch wrapping processes. As shown in FIG. 6, in an embodiment of a stretch wrapping carousel machine that utilises features of the present invention compressed air may be used to blow the start of the film into the wrap and also weld the film to itself at the end of a wrapping cycle to ensure there are no wrap tails from the pallet and thus a shipping product that will be accepted at distribution centres. The shown turntable system is a machine in which the pallets are wrapped and may be modified with the preferred six (6) finger roping system 3 in conjunction with pallets wrapped with the required air gap. When the cycle starts the sealing unit or mechanism 11 will raise an attaching arm close to the pallet. After one rotation the attaching arm will release the film and the blower 9 will push the film close to the pallet where it can then be wrapped into the film so the start of the wrap is enclosed within it. At the end of the wrapping cycle the multiple layers or bands of film 4*b* are pulled down via a different type of roping device post pre-stretch that brings all layers to a bundle that is approx. 100 mm wide. The film goes over a sealing support bracket of the sealing unit 11 where at least two layers or bands of the multiple bands of films are overlapped on each other. Once they are overlapped the sealing mechanism is then pressed across the sealing support bracket where heat is applied and they are welded together as one piece.

Consistent testing has shown a reduction on film material by approx. 30-60% depending on application. In one demonstration involving application for palletizing the produce of a tomato grower, it has been shown that unique programming and use of film is suitable for a rapid chill application with an Extrema™ in line stretch wrapping machine.

Some examples of use of embodiments of the present invention follow:

Food produce—Citrus
Conventional Machinery used: Propak: MAS-350
Material: Macrowrap 20 um×142 m×500 mm
Cut and Weigh Analysis of film used: 240 grams
Film Slitter in situ
Material: A preferred multiple band film—3 Slit 3×150 mm×1600 m
Cut and Weigh Analysis of film used: 110 grams
A unique program was created to allow maximum air flow while ensuring all crates had film across itself. Film usage was greatly reduced due to the gaps that were possible to create by working with the carriage and turntable speed.

FIG. 1 shows apparatus in accordance with a preferred embodiment of the present invention, suitable for permanent or removable connection to an existing wrapping machine such as a pallet wrapping machine (100), as shown. In a preferred embodiment, the present invention provides a commercially viable option for ventilation of wrapped pallets in cool rooms to reduce refrigeration energy cost. Accordingly, as shown in FIG. 1, a turntable wrapping machine can be adapted to utilise stretch wrap film in the form of a roll (1) of 3 bandings (2) on the one core which feeds through the stretch wrapping machine (100).

FIG. 2 illustrates a roping mechanism (6) in accordance with an embodiment of the present invention that receives bandings (2) of the stretch wrap film product (1) and by application of the roping fingers (3) individual bands (4) of roped film are produced for application to the pallet load in the operation of the wrapping machine. Whilst feeding through the roping mechanism (6) the film bandings (2) travel past components of the roping mechanism (6) such as the roping fingers (3) which rolls the edges adding strength to the bandings (2), effectively turning the bands (2) into roped sections of film (4). These roped widths (4) are pre-stretched and applied to the pallet and may be further stretched to provide the right measured load containment force.

FIG. 4 illustrates the device and apparatus of FIG. 1 from a top perspective view. The film holder/dispenser 1 holds the film and allows the film to be dispensed from the roll. The film 2 in its dispensable individual bands in preferred embodiments may comprise material of dimensions 3×150 mm×1600 m. The roping mechanism 3 bundles the film bands 4*a* before a Pre-Stretch head to allow for the roping process. Film being dispensed from the dispenser 1 is a single layer of film coming away from the roll and going through the roping mechanism 3 before it goes through the pre-stretch head.

FIG. 5 is a side view of the device and apparatus of FIG. 1 and shows the roping mechanism 3 and the guide roller 6 of the roping mechanism/fingers 3.

Parameters for two exemplary operational programs for controlling a stretch wrapping machine to perform the improved wrapping process with preferred wrapping cycles for optimum efficiency are shown below:

Example 1

Bottom Wraps: 1
Top Wraps: 1
Bottom Wrap Tension: 25%
Ascent Tension: 30%
Top Wrap Tension: 40%
Decent Tension: 40%
Rotation Speed: 7 rpm
Ascent Speed: 80 Hz
Descent Speed: 80 Hz
Flanging Time: 6 seconds
Initial Carriage Height: 3 cm
Final Turn No.: 1 rotation
Re-enforcement turns: 0
Reinforcement Height: 0
Roping Wraps: 1

Example 2

Bottom Wraps: 2
Top Wraps: 2
Bottom Wrap Tension: 35
Ascent Tension: 45
Top Wrap Tension: 35
Decent Tension: 45
Rotation Speed: 10 Rpm
Ascent Speed: 65 Rpm
Descent Speed: 65 Rpm
Flanging Time: 7 seconds
Initial Carriage Height: 0
Final Turn No.: 0
Re-enforcement turns: 1
Reinforcement Height: 150 cm
Roping Wraps: 0

For purposes of description herein, the terms "upper," "lower," "right," "left," "rear," "front," "vertical," "horizontal," "interior," "exterior," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the present specification are simply exemplary embodiments of the inventive concepts defined in the appended claims. Hence, specific dimensions and other physical characteristics relating to the embodiments disclosed herein are not to be considered as limiting, unless the claims expressly state otherwise. Additionally, unless otherwise specified, it is to be understood that discussion of a particular feature of component extending in or along a given direction or the like does not mean that the feature or component follows a straight line or axis in such a direction or that it only extends in such direction or on such a plane without other directional components or deviations, unless otherwise specified.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above-described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures.

The following sections I-VII provide a guide to interpreting the present specification.

I. TERMS

The term "product" means any material, machine, manufacture and/or composition of matter, unless expressly specified otherwise.

The term "process" means any process, algorithm, method or the like, unless expressly specified otherwise.

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

The term "invention" and the like mean "the one or more inventions disclosed in this specification", unless expressly specified otherwise.

The terms "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise.

The term "variation" of an invention means an embodiment of the invention, unless expressly specified otherwise.

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present specification, including anything which may be incorporated by reference", unless expressly specified otherwise.

The phrase "at least one of", when such phrase modifies a plurality of things (such as an enumerated list of things), means any combination of one or more of those things, unless expressly specified otherwise. For example, the phrase "at least one of a widget, a car and a wheel" means either (i) a widget, (ii) a car, (iii) a wheel, (iv) a widget and a car, (v) a widget and a wheel, (vi) a car and a wheel, or (vii) a widget, a car and a wheel. The phrase "at least one of", when such phrase modifies a plurality of things, does not mean "one of each of" the plurality of things.

Numerical terms such as "one", "two", etc. when used as cardinal numbers to indicate quantity of something (e.g., one widget, two widgets), mean the quantity indicated by that numerical term, but do not mean at least the quantity indicated by that numerical term. For example, the phrase "one widget" does not mean "at least one widget", and therefore the phrase "one widget" does not cover, e.g., two widgets.

The phrase "based on" does not mean "based only on", unless expressly specified otherwise. In other words, the phrase "based on" describes both "based only on" and "based at least on". The phrase "based at least on" is equivalent to the phrase "based at least in part on".

The term "represent" and like terms are not exclusive, unless expressly specified otherwise. For example, the term "represents" do not mean "represents only", unless expressly specified otherwise. In other words, the phrase "the data represents a credit card number" describes both "the data represents only a credit card number" and "the data represents a credit card number and the data also represents something else".

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "e.g." and like terms mean "for example", and thus does not limit the term or phrase it explains. For example, in the sentence "the computer sends data (e.g., instructions, a data structure) over the Internet", the term "e.g." explains that "instructions" are an example of "data" that the computer may send over the Internet, and also explains that "a data structure" is an example of "data" that the computer may send over the Internet. However, both "instructions" and "a data structure" are merely examples of "data", and other things besides "instructions" and "a data structure" can be "data".

The term "i.e." and like terms mean "that is", and thus limits the term or phrase it explains. For example, in the sentence "the computer sends data (i.e., instructions) over the Internet", the term "i.e." explains that "instructions" are the "data" that the computer sends over the Internet.

Any given numerical range shall include whole and fractions of numbers within the range. For example, the range "1 to 10" shall be interpreted to specifically include whole numbers between 1 and 10 (e.g., 2, 3, 4, . . . 9) and non-whole numbers (e.g., 1.1, 1.2, . . . 1.9).

II. DETERMINING

The term "determining" and grammatical variants thereof (e.g., to determine a price, determining a value, determine an object which meets a certain criterion) is used in an extremely broad sense. The term "determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing, and the like.

The term "determining" does not imply certainty or absolute precision, and therefore "determining" can include estimating, extrapolating, predicting, guessing and the like.

The term "determining" does not imply that mathematical processing must be performed, and does not imply that numerical methods must be used, and does not imply that an algorithm or process is used.

The term "determining" does not imply that any particular device must be used. For example, a computer need not necessarily perform the determining.

III. INDICATION

The term "indication" is used in an extremely broad sense. The term "indication" may, among other things, encompass a sign, symptom, or token of something else.

The term "indication" may be used to refer to any indicia and/or other information indicative of or associated with a subject, item, entity, and/or other object and/or idea.

As used herein, the phrases "information indicative of" and "indicia" may be used to refer to any information that represents, describes, and/or is otherwise associated with a related entity, subject, or object.

Indicia of information may include, for example, a symbol, a code, a reference, a link, a signal, an identifier, and/or any combination thereof and/or any other informative representation associated with the information.

In some embodiments, indicia of information (or indicative of the information) may be or include the information itself and/or any portion or component of the information. In some embodiments, an indication may include a request, a solicitation, a broadcast, and/or any other form of information gathering and/or dissemination.

IV. FORMS OF SENTENCES

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device/article (whether or not they cooperate) may alternatively be used in place of the single device/article that is described. Accordingly, the functionality that is described as being possessed by a device may alternatively be possessed by more than one device/article (whether or not they cooperate).

Similarly, where more than one device or article is described herein (whether or not they cooperate), a single device/article may alternatively be used in place of the more than one device or article that is described. For example, a plurality of computer-based devices may be substituted with a single computer-based device. Accordingly, the various functionality that is described as being possessed by more than one device or article may alternatively be possessed by a single device/article.

The functionality and/or the features of a single device that is described may be alternatively embodied by one or more other devices which are described but are not explicitly described as having such functionality/features. Thus, other embodiments need not include the described device itself, but rather can include the one or more other devices which would, in those other embodiments, have such functionality/features.

V. DISCLOSED EXAMPLES AND TERMINOLOGY ARE NOT LIMITING

Neither the Title nor the Abstract in this specification is intended to be taken as limiting in any way as the scope of the disclosed invention(s). The title and headings of sections provided in the specification are for convenience only, and are not to be taken as limiting the disclosure in any way.

Numerous embodiments are described in the present application, and are presented for illustrative purposes only.

The described embodiments are not, and are not intended to be, limiting in any sense. The presently disclosed invention(s) are widely applicable to numerous embodiments, as is readily apparent from the disclosure. One of ordinary skill in the art will recognise that the disclosed invention(s) may be practised with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is not a literal description of all embodiments of the invention(s). Also, the present disclosure is not a listing of features of the invention(s) which must be present in all embodiments.

Devices that are described as in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for long period of time (e.g. weeks at a time). In addition, devices that are in communication with each other may communicate directly or indirectly through one or more intermediaries.

A description of an embodiment with several components or features does not imply that all or even any of such components/features are required. On the contrary, a variety of optional components are described to illustrate the wide variety of possible embodiments of the present invention(s). Unless otherwise specified explicitly, no component/feature is essential or required.

Although process steps, operations, algorithms or the like may be described in a particular sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention(s), and does not imply that the illustrated process is preferred.

Although a process may be described as including a plurality of steps, that does not imply that all or any of the steps are preferred, essential or required. Various other embodiments within the scope of the described invention(s) include other processes that omit some or all of the described steps. Unless otherwise specified explicitly, no step is essential or required.

Although a process may be described singly or without reference to other products or methods, in an embodiment the process may interact with other products or methods. For example, such interaction may include linking one business model to another business model. Such interaction may be provided to enhance the flexibility or desirability of the process.

Although a product may be described as including a plurality of components, aspects, qualities, characteristics and/or features, that does not indicate that any or all of the plurality are preferred, essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

An enumerated list of items (which may or may not be numbered) does not imply that any or all of the items are equivalent to each other or readily substituted for each other.

All embodiments are illustrative, and do not imply that the invention or any embodiments were made or performed, as the case may be.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

We claim:

1. A method of stretch wrapping goods with stretch wrap film, the method comprising the steps of:

dispensing at least one band of film from a single stretch film core wherein the single core comprises a plurality of bands of film that are pre-cut from a unitary width of stretch film and rewound onto the single core prior to dispensing;

roping the at least one band of film by edging at least one lateral side edge of the film;

pre-stretching the film by passing the roped film through a pre-stretcher; and wrapping the roped pre-stretched film around the goods, wherein the step of roping is performed prior to the step of pre-stretching thereby strengthening the film to withstand pre-stretching to elongations exceeding 200% without breakage.

2. The method of claim 1, wherein the combination of the steps of roping and pre-stretching the roped film binds the stretch film material into a higher yield strength material than the at least one band of film dispensed from the single stretch film core such that the wrapped film provides increased load containment force while using at least 20 to 40% less plastic film material compared to non-roped film.

3. Apparatus for applying stretch wrap film to unitize a pallet load of goods, the apparatus comprising: a film roll carriage adapted to accommodate at least one stretch wrap film roll and dispense a plurality of individual bands of stretch wrap film from a single film roll; a roping mechanism comprising roping fingers to rope the dispensed individual bands of film; and a pre-stretcher for pre-stretching the dispensed individual bands of film, characterized in that:

the film roll carriage is operatively connected to a slitter rewinder adapted to slit a unitary width of stretch wrap film into the plurality of individual bands of stretch wrap film and to rewind the plurality of individual bands back onto the single film roll core prior to dispensing; and, wherein the plurality of individual bands of stretch wrap film are passed through the roping mechanism prior to the pre-stretcher such that the wrapped film provides increased load containment force while using at least 20 to 40% less plastic film material compared to non-roped film.

4. Apparatus as claimed in claim 3, wherein the film roll carriage dispenses at least three individual bands of stretch wrap film from a single film roll.

5. Apparatus as claimed in claim 4, wherein the roping mechanism comprises at least six roping fingers to form the at least three individual bands of stretch wrap film.

6. Apparatus as claimed in claim 3, further comprising a stretch wrap carousel for wrapping the roped and pre-stretched film around the goods, wherein at least one band of film is passed through the roping mechanism prior to the pre-stretcher.

7. Apparatus as claimed in claim 3, wherein the apparatus further comprises one or a combination of:

compressed air means for applying compressed air to guide an end of at least one band of film into the wrapped goods;

welding means for welding at least one end of at least one band of film to the wrapped film at the end of a wrapping cycle.

* * * * *